United States Patent [19]

Hardy

[11] Patent Number: 4,633,691

[45] Date of Patent: Jan. 6, 1987

[54] SPRING LOOP KEY HOLDER

[76] Inventor: Gilbert F. Hardy, 8191 Sterling Ave., Huntington Beach, Calif. 92646

[21] Appl. No.: 784,733

[22] Filed: Oct. 7, 1985

[51] Int. Cl.[4] ..... A45F 5/02

[52] U.S. Cl. ..... 70/456 B; 70/458; 70/459; 224/252

[58] Field of Search ..... 70/456 R, 456 B, 457, 70/458, 459; 224/225, 226, 252, 253, 268, 269, 224/271, 904; 24/3 K

[56] References Cited

U.S. PATENT DOCUMENTS

| | | | |
|---|---|---|---|
| 1,364,709 | 1/1921 | Butler | 70/456 R |
| 2,679,674 | 6/1954 | Hanna | 70/456 B |
| 3,176,489 | 4/1965 | Sonntag | 70/456 B |
| 3,379,041 | 4/1968 | Hanna | 70/456 B |

*Primary Examiner*—Robert L. Wolfe
*Attorney, Agent, or Firm*—Wm. Jacquet Gribble

[57] ABSTRACT

A flat strip is bent into a discontinuous loop with an end of one limb slanted to contact the inner side of the other limb so that two semi-circles are separated by one continuous limb length and one discontinuous limb length. The continuous length is slotted for at least one-half of its long dimension, with a wider aperture at the upper end. Key hooks, preferably for individual keys, that have a large head and a large closed circle at opposite ends of a small shank fit into the slot, retained by the end of the discontinuous limb that slants across the space between limbs. The loop provides passage for a belt or other support above a thruster that affords a way of separating the limbs to move key hooks in and out of the loop past the slanted limb end or lock.

More than one key hook may be used and one way of separating hooks includes a small disc or drum rotatably seated at the bottom of the slot in the continuous limb.

8 Claims, 8 Drawing Figures

SPRING LOOP KEY HOLDER

BACKGROUND OF THE INVENTION

The invention relates to apparatus for securely and inexpensively attaching one or more keys to a belt or other support so that each key may be easily displaced and replaced. Applicant is the inventor of previous U.S. Pat. No. 3,970,227 issued July 20, 1976 and entitled "Spring Loop Key Ring and Belt Attachment" and also U.S. Pat. No. 4,051,874 issued Oct. 4, 1977 entitled "Spring Loop Key Ring and Method For Making Same". In the present invention manufacture may be done easily from narrow strips of resilient metal and use is readily comprehended. While other key holders and key rings have been propounded and even sold by other inventors none s shows the unique combination of elements assembled by applicant to afford ease of manufacture and use with such utility.

SUMMARY OF THE INVENTION

The invention contemplates a key holder for attachment to a s suspension device such as a belt or circlet and comprises a support loop with obverse and reverse limbs, the reverse limb ending in a lock tongue extending between limbs to contact the obverse limb inner surface. A container loop for one or more key hooks is defined by an extension of the obverse limb that extends away from the support loop and then back toward the support loop to end in a free end in line with the reverse limb but spaced from it. A key hook with an enlarged head, a small shank and a key engaging portion is adapted to enter an opening at the terminus of an elongate slot in the central part of the obverse limb with the shank of the hook residing in the slot and the head protruding inwardly. The shank slides in the slot and moves past the lock tongue into the part of the slot remote from the support loop when a transverse thruster attached to the reverse limb and extending through the obverse limb is pressed to separate the limbs. The thruster may be an integral part of the reverse limb or, alternatively, an added rod. The lock tongue returns to position against the inner surface of the obverse limb to preclude removal of key hooks without thrusting the limbs apart.

In an alternate embodiment a slotted disc is journalled near the bottom end of the slot to present one or more slotted portions in line with the limb slot to accept a key hook. By turning the disc on its journal removal of a key hook is prevented. The disc may be journalled on a central pin or upon a drum-like assembly formed integrally with the limbs.

While the key hooks may vary in configuration and as to the number of individual keys each carries, each hook has a head, a smaller shank and a key circle. The slots may differ in shape and accommodate the thruster or be separate from it as manufacture dictates, but the small dimension of the slot is roughly equal to the hook shank diameter and smaller than the head or circle size.

These and other features and advantages of the invention are apparent from the following detailed description and drawing.

DESCRIPTION OF THE PREFERRED EMBODIMENTS

Figures 1, 2, 3, 4, 5, 6, 7, 8:
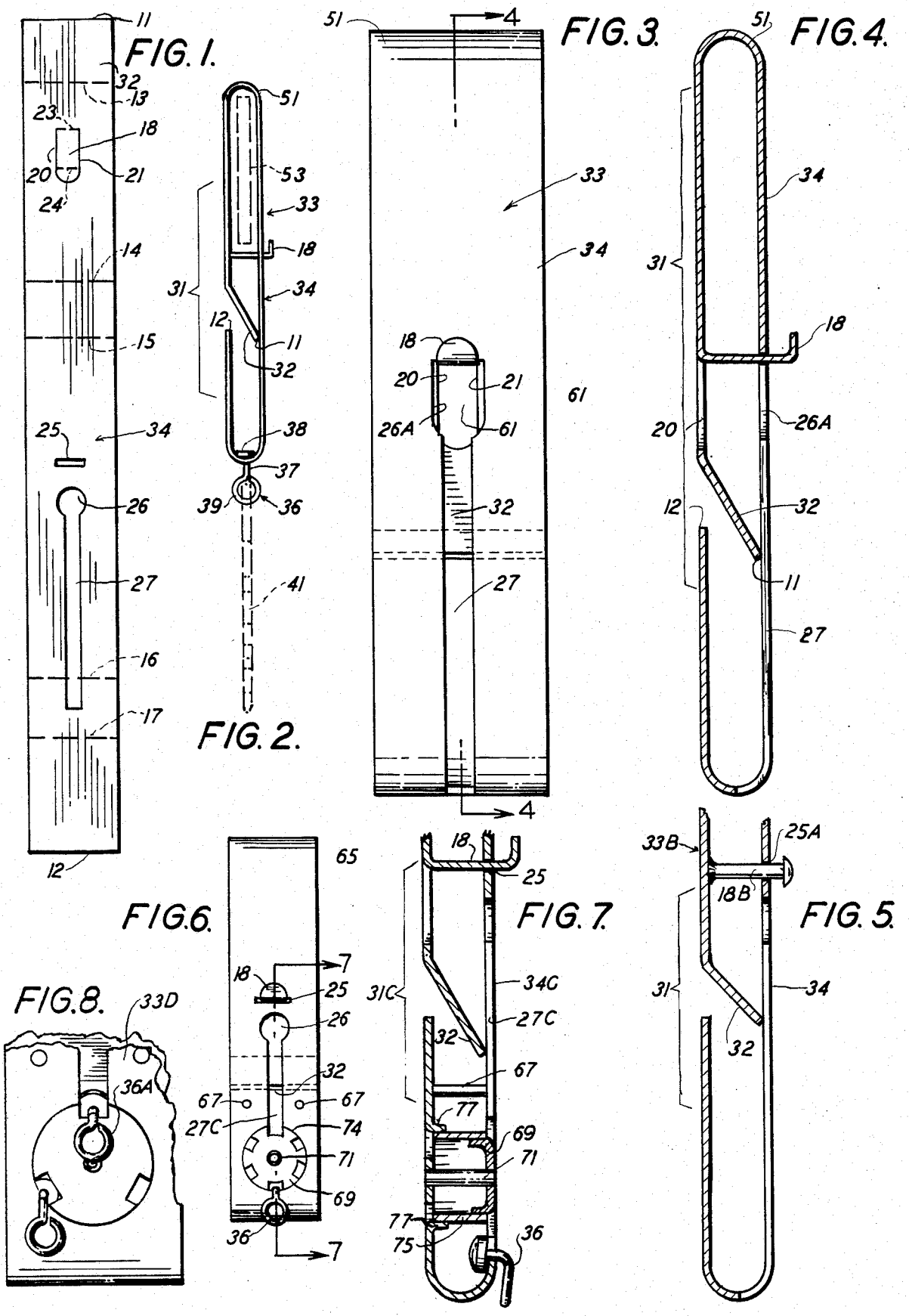
FIG. 1 is a schematic view of a flat pattern before forming into the key holder of the invention.
FIG. 2 is a side elevational view of a key holder formed from the blank pattern of FIG. 1.
FIG. 3 is an enlarged front elevational view of an alternate embodiment of the invention having a free thruster port.
FIG. 4 is a sectional elevational view taken along line 4—4 of FIG. 3.
FIG. 5 is a fragmentary sectional elevational view similar to FIG. 4 showing an alternate form of thruster.
FIG. 6 is a further alternate embodiment of the invention shown to a reduced scale and having a multiple key holder.
FIG. 7 is an enlarged sectional elevational view taken along line 7—7 of FIG. 6.
FIG. 8 is an enlarged scale fragmentary fron elevational view of an alternate embodiment having a plurality of key holders.

In the drawing like parts are referred to by like characters.

In FIG. 1 a strip 10 of springy metal or other material is shown in flat form, punched and ready to be dieformed into the desired shape. In the flat the strip is several times its width in length, the ends being indicated by top end 11 and bottom end 12. The potential bend points are indicated by broken lines 13 through 17.

A thruster 18 is defined by cut lines 20, 21 and the eventual bend lines are indicated at 23 and 24. The port or aperture for the thruster is a rectangular aperture 25 directly above an upper larger port 26 of elongate vertical slot 27. As can be seen by inspection of FIG. 2, the material of the blank from 12 to 17 becomes a part of a discontinuous reverse limb 31 while the blank material between 11 and 14 becomes the second part of the discontinuous limb 31. The material from 11 to 13 becomes the lock tongue 32, of a holder 33.

As can be seen from FIG. 2, reverse limb 31 is one side of a loop having also an obverse limb 34 ih which aperture 25 and elongate slot 27 reside. The lock tongue 32 incised from part of the reverse limb slants across the space between limbs to a region intermediate of slot 27, normally contacting the inner surface of the obverse limb. The slot 27 extends from aperture 26 to the middle of the semi-circular bend between 16 and 17 and is shown with a key hook 36 lodged at that point.

The key hook has a shank 37 between a larger head 38 and a key circle 39, also larger than the shank. The shank is equal in size or slightly smaller than the width of the slot 27, while the head is smaller than aperture 26. A key is shown in phantom lines in FIG. 2 attached to the key hook 36, the key being indicated by character 41.

The material of the key hook is dictated only by the intended use, and either metal or plastic may be used, depending largely upon the material of the key itself. The material of the strip 10 may be any metal or plastic that will deform under the pressure of the thruster 18 and spring back enough for the lock tongue to once again bear against the obverse limb to secure the key hook in the slot.

The upper juncture of the two limbs is a secondsemicircular band 51 that is formed from the blank material lying between the broken lines 14 and 15 of FIG. 1. This semi-circular band forms a loop above the thruster which defines a channel for a belt 53 shown in broken lines in FIG. 2. The belt supports the key holder that in turn supports the key hooks or hook which receive the keys.

To use the key holder of the invention the holder is first held by a belt or other device convenient for the user. Then the key hook, preferably with an attached key, is inserted head first into aperture 26 and the shank pushed down slot 27. The thruster may be used at this time to exert pressure on the reverse limb to move the lock tongue away from the slot so that the hook head amy pass below the lock tongue. Alternatively, the head may be used to displace the lock tongue as it is pushed down. Then the shank continues along the slot to terminate against the end of the slot in the semi-circle that connects the obverse limb to the reverse limb of holder 33.

In the alternate embodiment presented in FIGS. 3 and 4 the loop is substantially the same as in FIG. 2 with the difference lying in the aperture for the slot. To reduce the preciseness needed for passing the integral thruster through the obverse limb 34 and the aperture enlarged at the top of the slot 27, the aperture 26A is cut upward to merge with the opening at 25 to form a longer aperture 25A through which the thruster 18 may be more easily manipulated when the key holder is first formed. The resultant opening in limb 31 is visible through the enlarged aperture in FIG. 3, at 61 in holder 33A.

FIG. 5 illustrates fragmentarily a key holder 33B similar to that of FIG. 2 except that the thruster is not formed from the limb 31. Instead a headed rod 18B is welded or otherwise attached to the reverse limb 31 and extends through an aperture 25A exteriorly of limb 34 in correct position to bear against limb 31 to free the slot path for added key movement up or down.

In FIGS. 6 and 7 an alternate key holder 65 similar in most aspects to the key holder 33 of FIG. 2 is shown in different scales in in the two Figures. The holder has upper and lower semi-circular ends like FIG. 2 embodiment, and an opening 25 receiving a thruster 18. A slanting lock tongue 32 merges with the inner surface of an obverse limb 34C, below the enlarged aperture 26. However, a pair of transverse rivets 67 hold limb 31C in exact relationship to obverse limb 34C in order to retain a peripherally slotted disc 69 in the plane of the obverse limb about a pivot 71. The disc in FIG. 6 has six slots that line up with a limb slot 27C when the disc rotates about its pivot.

In order to establish the disc about its pivot, obverse limb 34C is provided with a circular port 74 to receive the disc 69. A small drum 75 extends from bent prongs from the slots in the disc that are internal of the drum and is received by bent prongs 77 from the limb 31C externally of the drum to retain the disc about its pivot 71.

As a key hook is introduced through aperture 26 past lock tongue 32 in slot 27C, the disc is rotated to present one of its slots in the periphery to the elongate slot 27C and receives a key hook. The key holder in the Figures shown may receive six key hooks, each of which always has a capacity of one or more keys. Release of a key hook from the disc is the reverse procedure, with the desired key rotated to the elongate slot, lifted in the slot and released upward by manipulation of the thruster and out of aperture 26.

While six places in the rotating disc have been shown, a lesser or greater number may be accommodated within the dimensional confines of the key holder. For instance, FIG. 8 shows a holder 33D fragmentarily which receives three key hooks. A similar design can receive two.

While five embodiments have been shown to illustrate the scope of the invention, all derive from the same inventive concept of combining elements into a unique combination. While the apparatus shown and described does not exhaust the inventive scope, since many kinds of devices within that scope will occur to those skilled in this particular art, the illustrative material herein is belived to present a true picture of the invention and the definition thereof can best be defined by reference to the appended claims rather than the illustrative material herein.

I claim:

1. In a key holder for attachment to a suspension device the combination comprising a support loop, obverse and reverse limbs on the support loop, said reverse limb terminating in a lock tongue merging with said obverse limb, a container loop defined by an extension of said obverse limb both away from and toward said support loop and terminating in a free end spaced from the obverse limb, a key shank, a key head and a key circle defining a key hook, an elongate pair of walls in the obverse limb defining a slot adapted to accept said key hook, said slot having a first portion adapted to receive a key hook head and a second portion adapted to receive a key hook shank, a thruster extending transversely between obverse and reverse limbs and penetrating one of said limbs to provide means for thrusting said limbs apart to pass said key hook into said slotted second portion and retain said key hook in the second portion until the thruster separates the obverse and reverse limbs to displace the lock tongue from the limb.

2. A key holder in accordance with claim 1 further comprising means for retaining two key hooks.

3. A key holder in accordance with claim 2 wherein said means for retaining two key hooks comprises a slotted disc journalled in said obverse limb, said disc slots adapted to align on rotation with said obverse limb slot.

4. In a key holder for attachment to a suspension device the combination comprising an obverse limb, a reverse limb, said limbs defining a discontinuous loop, a lock tongue extending from said reverse limb transversely to contact said obverse limb, a pair of walls defining a elongate slot in the obverse limb, a key hook having a shank, a head and a key circle and adapted to lodge in said elongate slot a thruster extending transversely between obverse and reverse limbs and penetrating one of said limbs to provide means for thrusting said limbs apart to pass said key hook into said elongated slot and retain said key lock in the slot until the truster separates the obverse and reverse limbs to displace the lock tongue from the limb, a key disc, prongs extending inwardly from said disc to define a slotted disc exterior and a discontinuous drum mount, a transverse drum on said prongs holding said disc at one drum end and journalled at the other drum end on a discontinuous circle of reverse limb prongs incised in said limb, said disc being rotatable on said prongs to align selectively with said slot.

5. A key holder in accordance with claim 4 further comprising a thruster fixed to said reverse limb and extending transversely through said obverse limb in an aperture defined by rectangular walls.

6. A key holder in accordance with claim 4 further comprising a thruster fixed to said reverse limb and extending transversely through said obverse limb in an aperture defined by walls extending from said pair of walls defining said elongate slot.

7. A key holder in accordance with claim 4 further comprising a thruster integral with said reverse limb.

8. A key holder in accordance with claim 4 further comprising a thruster mechanically affixed to said reverse limb.

* * * * *